United States Patent [19]

Willcocks, Jr.

[11] Patent Number: 4,828,121

[45] Date of Patent: May 9, 1989

[54] SHELF EXPANDER FOR SUPERMARKETS

[76] Inventor: Reginald Willcocks, Jr., 1 Joel Pl., Port Washington, N.Y. 11050

[21] Appl. No.: 132,905

[22] Filed: Dec. 14, 1987

[51] Int. Cl.[4] ..... A47F 5/08

[52] U.S. Cl. ..... 211/94; 211/126

[58] Field of Search ..... 211/94, 86, 88, 73, 211/57.1, 126, 72, 90; 248/459, 174, 221.4, 223.4, 205.3; 108/152; 229/16 R, 16 D

[56] References Cited

U.S. PATENT DOCUMENTS

| | | | |
|---|---|---|---|
| D. 171,595 | 3/1954 | Harriton | 211/73 X |
| 3,189,187 | 6/1965 | Guyer, Jr. et al. | 211/126 X |
| 3,494,479 | 2/1970 | Martin | 248/174 X |
| 3,744,645 | 7/1973 | Hochman | 211/126 |
| 4,693,441 | 9/1987 | Conway | 248/221.4 X |

*Primary Examiner*—Reinaldo P. Machado

*Assistant Examiner*—Sarah A. Lechok Eley

*Attorney, Agent, or Firm*—Michael Ebert

[57] ABSTRACT

A flat blank formed of transparent, synthetic plastic material which when erected creates an open bin that is readily secured to the front edge of a supermarket shelf to enlarge its capacity to store and display additional merchandise. The blank is constituted by a rectangular base panel whose opposing long sides are joined by living hinges to the corresponding sides of rear and front panels, the opposing ends of the rear panel being joined by living hinges to end panels. By folding up the front and rear panels and swinging in the end panels and latching them to the front and base panels, a three-dimensional bin is created whose rear panel can then be adhesively attached to holding clips received in the existing price channel at the front edge of the shelf.

6 Claims, 2 Drawing Sheets

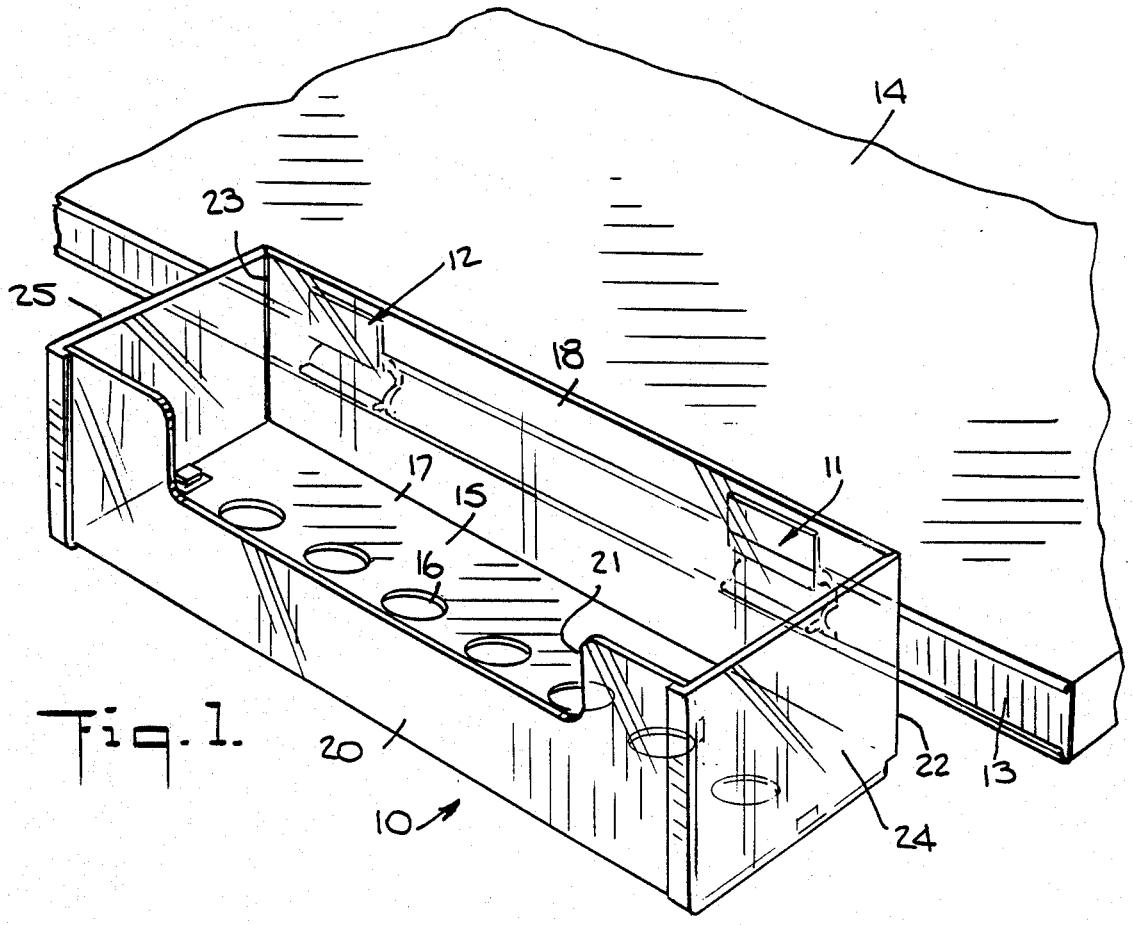
Fig. 1.
Fig. 2.
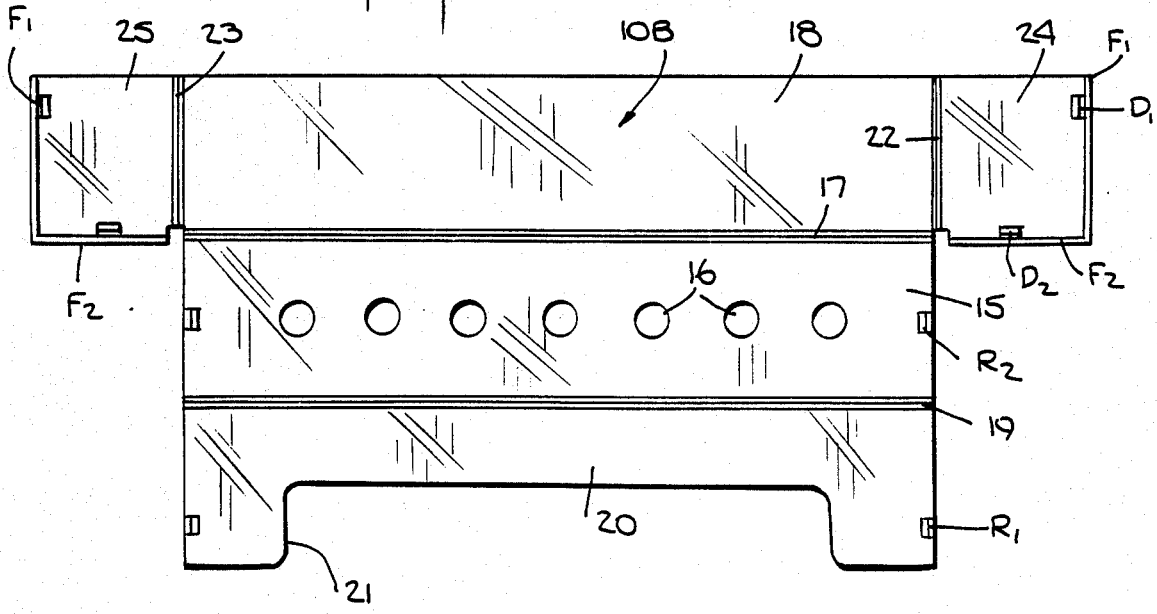

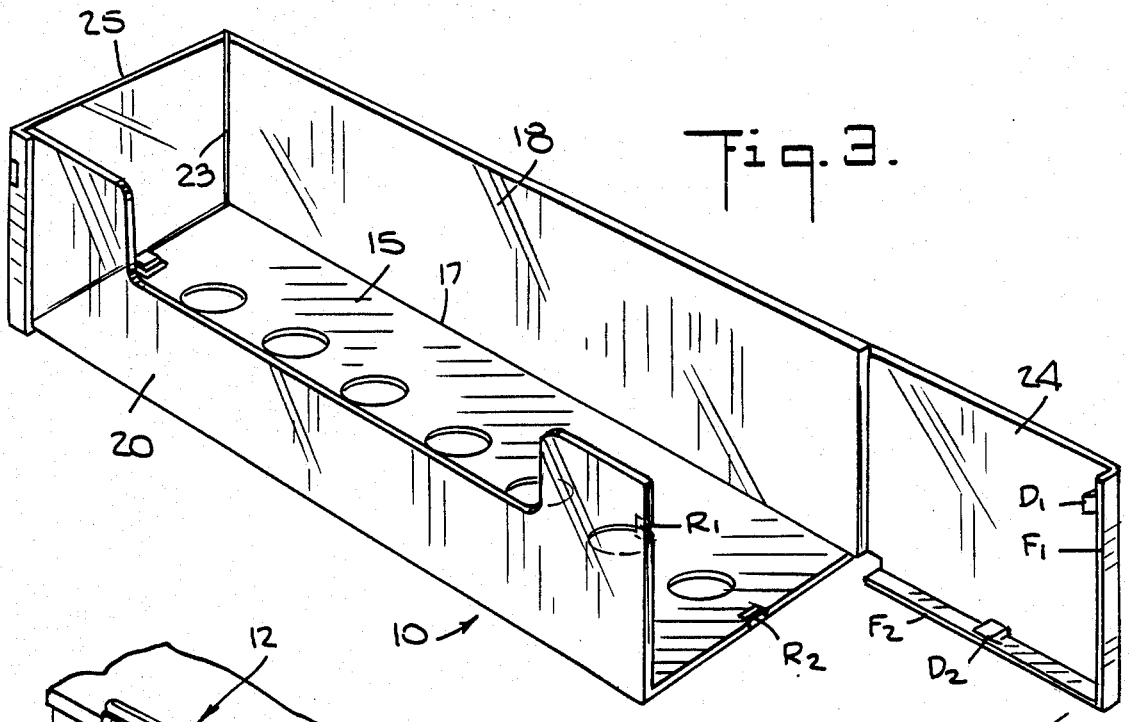
Fig. 3.
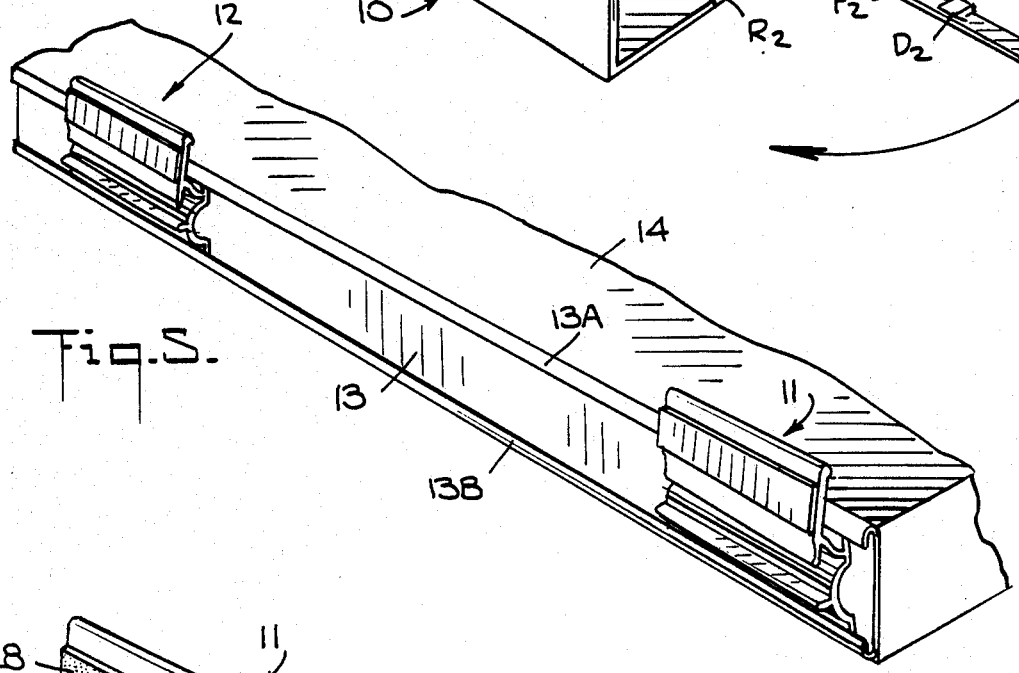
Fig. 5.
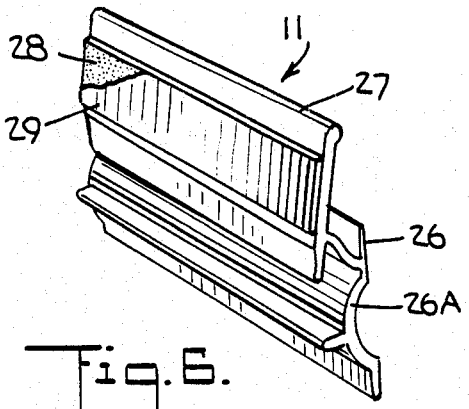
Fig. 6.
Fig. 4.
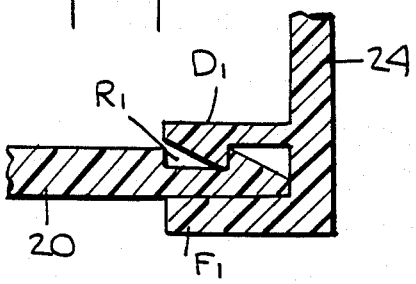

SHELF EXPANDER FOR SUPERMARKETS

BACKGROUND OF INVENTION

1. Field of Invention

This invention relates generally to a shelf extender making it possible to enlarge the capacity of a supermarket shelf to which the extender is attached to store and display additional merchandise, and more particularly to an all-purpose shelf extender that comes in the form of a flat blank that can readily be erected to create a transparent, three-dimensional open bin whose rear wall may be adhesively secured to holding clips receiving in the existing price channel at the front edge of the shelf to be extended.

2. Status of Prior Art

The modern supermarket carries many hundreds of items such as canned and bottled foods and beverages, dry cereals, boxed soaps, toothpaste, cosmetics and drugs as well as sundry other articles of merchandise. The interior architecture of the typical supermarket is such as to facilitate the flow therethrough of consumer-propelled shopping carts. To this end, the supermarket layout is arranged to define parallel aisles, each of which is banked by shelves on which various items of merchandise are stored and displayed. In this way, a customer pushing a shopping cart along any aisle in the store can see the merchandise displayed on the shelves and transfer bottles, boxes or cans of merchandise he wishes to purchase to his shopping cart.

Each item of merchandise usually has its price marked thereon or it carries a UPC marking from which the price can be determined by a computer terminal at the checkout counter. In order that the consumer know the price without having to remove the item from the shelf to examine the price marking thereon, the edge of each shelf is provided with a price channel which runs the length of the shelf. Inserted in this channel are cards having printed thereon the price of the item on the shelf directly above the cart. Since supermarket prices are subject to frequent change as a result of special sales and other factors, the advantage of a price channel is that it lends itself to easy replacement of one price card by another. The present invention, as will become later evident, exploits the existence of this price channel for a purpose having nothing to do with pricing.

Though the typical modern supermarket can accommodate hundreds of different products and has an enormous overall shelf capacity, in many cases this capacity still falls short of the store's requirements under certain special circumstances. Manufacturers in our highly competitive economy continue to add to their product line and to introduce new items requiring additional shelf space. Many of these new products, at the time they are first introduced to the market, are heavily promoted in the media, so that the demand therefor may surge, possibly to the detriment of competitive products. In order for the supermarket to satisfy a demand for a heavily-promoted item, it is important that shelf space be found for this item whose placement takes into account that the shopper is likely to be looking for this particular item.

It is important, therefore, that whatever shelf space is allocated to the new item be conspicuous so that a shopper is not forced to hunt for it among the multitude of other items available in the supermarket. In a supermarket, the shelves are in a vertical array, one above the other, and if an item is placed on the lowermost shelf, it may be overlooked by the shopper who is best able to see items which appear on a shelf at the shopper's eye level. The natural tendency of a supermarket merchandiser is to place those items having the greatest current sales appeal on the most conspicuous shelves and to relegate those of lesser interest to other shelves. Hence the supermarket merchandiser is faced not only with the problem of finding shelf space for a new item, but also with the effective placement of this shelf.

In recent years, in order to provide additional shelf space, shelf expanders have been devised in the form of open wire trays adapted to clamp onto the front edge of the shelf. Such shelf extenders are relatively expensive and they are fairly difficult to attach to a shelf or to be detached therefrom. Moreover, these known types of shelf-expanders also require a substantial amount of storage space which in a typical supermarket is in short supply. The number of shelf expanders in use at a given time depends on changing circumstances, so that while on a particular day no more than, say, five such expanders may be in use, at other times more than thirty or forty may be needed. To meet these changing requirements, the supermarket must keep in storage a large number of shelf expanders, and these require a substantial amount of storage space.

Another drawback of known types of shelf expanders is that the means used to attach to the expanders for the front edge of the shelf may interfere with the removal of items resting on this shelf or partially block these items from view.

SUMMARY OF INVENTION

In view of the foregoing, the main object of the invention is to provide an all-purpose shelf expander formed from a flat blank of synthetic plastic material, whereby a large number of such blanks may be transported in a compact package and stored in a confined storage space.

More particularly, an object of this invention is to provide a blank of the above-type which when erected creates a transparent, three-dimensional bin having a large capacity for displaying and storing merchandise at a position directly in front of the shelf to which the bin is attached, thereby effectively enlarging the capacity of this shelf.

Also an object of the invention is to provide a shelf expander which is adhesively attachable to holding clips received in the existing price channel on the front edge of the shelf, thereby simplifying the attachment or detachment of the shelf expander without interfering with the removal of items from this shelf or blocking them from view.

Yet another object of the invention is to provide a shelf expander blank that may be mass-produced at low cost.

Briefly stated, these objects are attained in a flat blank formed of transparent, synthetic plastic material which when erected creates an open bin that is readily secured to the front edge of a supermarket shelf to enlarge its capacity to store and display additional merchandise. The blank is constituted by a rectangular base panel whose opposing long sides are joined by living hinges to the corresponding sides of rear and front panels, the opposing ends of the rear panel being joined by living hinges to end panels. By folding up the front and rear panels and swinging in the end panels and latching them to the front and base panels, a three-dimensional bin is created whose rear panel can then be adhesively attached to holding clips received in the existing price channel at the front edge of the shelf.

BRIEF DESCRIPTION OF DRAWINGS

For a better understanding of the invention as well as other objects and further features thereof, reference is made to the following detailed description to be read in conjunction with the accompanying drawings, wherein:

FIG. 1 in a perspective view, a shelf expander in accordance with the invention mounted on the price channel of a supermarket shelf.

FIG. 2 a plan view of the blank, which when erected, forms the shelf expander;

FIG. 3 illustrates the manner in which the blank is erected;

FIG. 4 is a detail showing hos end panel latching is effected;

FIG. 5 is a separate view of the price channel and of the holding clips received therein; and FIG. 6 is a perspective view of one of the holding clips.

DESCRIPTION OF INVENTION

FIG. 1 shows a shelf expander, generally designated by numeral 10, in accordance with the invention. It will be seen that the expander has an open, bin-like, rectangular form and is adhesively attached by holding clips 11 and 12 to the existing price channel 13 at the front edge of a supermarket shelf 14.

Shelf expander 10 is fabricated entirely of transparent, synthetic plastic material such as polyvinyl chloride of acrylic; and as shown in FIG. 2, it is molded or otherwise fabricated in the form of a flat blank 10B of this material. The blank and the shelf expander created thereby includes a rectangular base panel 15 having a longitudinal row of clean-out holes 16 therein to facilitate cleaning of the bin.

One long side of base panel 15 is joined by a living hinge 17 to the corresponding side of a rear panel 18 of the same length, while the opposing long side of base panel 15 is joined by a living hinge 19 to the corresponding side of a front panel 20 of the same length. The upper edge of front panel 20 is provided with an elongated U-shaped cutout 21 to provide easy access to merchandise stored and displayed in the open bin.

The opposing ends of rear panel 18 are respectively joined by living hinges 22 and 23 to the corresponding ends of end panels 24 and 25 which have the sam end dimensions. Formed at the front edge of each end panel is a right angle flange $F_1$, and formed at the bottom edge thereof is a right angle flange $F_2$. When the blank is erected, flanges $F_1$ on the end panels 24 and 25 overlie the end margins of front panel 20, and flanges $F_2$ then overlie the margins of base panel 16 to stabilize the bin structure.

Each end panel is provided with detent fingers $D_1$ and $D_2$. Finger $D_1$ is adapted to snap into a complementary detent recess $R_1$ at the end margin of front panel 20 adjacent its upper edge, while finger $D_2$ is adapted to snap into a complementary detent recess $R_2$ at about the midpoint of the end margin of base panel 15 (see FIG. 4).

Hence to erect blank 10B, the rear panel 18 and the front panel 20 are folded up at right angles to base panel 15, as shown in FIG. 3, and the end panels 24 and 25 are swung in and latched by the snap-in detents to base panel 15 and front panel 20 to form a sturdy, three-dimensional bin.

As shown in FIG. 5, price channel 13 secured to the front edge of supermarket shelf 14 is provided with parallel rails 13A and 13B which normally serve to receive the long edges of a price card. Holding clips 11 and 12 are adapted to be received between these rails to support the shelf expander. Each clip, as shown by clip 11 in FIG. 6, is formed of flexible plastic material and includes a rear slide plate 26 having an arcuate section 26A to enhance the flexibility of this plate so that it can be tensioned and securely retained in the price channel.

Cantilevered from slide plate 26 is a support plate 27 having adhered thereto the rear face of a band 28 of double-faced adhesive having high tack properties. The front face is covered by a removable protector sheet 29 which, after the holding clip is inserted in the price channel, is peeled off to expose the front face of the adhesive band.

Hence to mount the shelf expander on the holding clips, one presses the rear panel 18 of shelf expander 10 against the exposed adhesive faces of the clips. The strength of this adhesive attachment is such as to hold the shelf expander securely in place in front of the shelf to provide a bin for accommodating merchandise to be stored and displayed. And should it later be necessary to remove the shelf expander, it is a simple matter to detach it from the holding clips. Each holding clip also has a stiffening ridge 30 spaced below the support plate to contact the rear panel of the expander and thereby maintain the expander in a generally level attitude with respect to the shelf.

Because blanks 10B are flat, a stack of such blanks may be placed on a compact box for shipment and storage until such time as a need arises for a shelf expander, at which point a blank is taken out of the box and erected and latched, without tools, to create a three-dimensional bin.

Thus the supermarket may quickly set up shelf expanders on appropriate shelves whenever there is a need therefor, and remove the expanders when they have served their purpose. The clips may be designed to cause the shelf expander attached thereto to tip slightly upward to allow for good visibility and ease of product removal from the shelf above and below the expander.

While there has been shown and described a preferred embodiment of a shelf expander for supermarkets in accordance with the invention, it will be appreciated that many changes and modifications may be made therein without, however, departing from the essential spirit thereof. Thus instead of a box-like expander, the end panels may be provided with a sloped front edge so that the front panel when latched to the end panel is likewise sloped to create a trough-like bin.

And while a device according to the invention has been disclosed herein as an expander or extender for a supermarket shelf, it is useful for other types of shelves, whether found in a retail store, an ofice, a stock room or in a home. When the shelf to be extended lacks a price channel for receiving holding clips, then the holding clips for supporting the shelf expander or extender may be screwed or otherwise attached to the edge of the shelf to be extended.

I claim:

1. A shelf expander attachable to the exposed edge of a supermarket shelf having a price channel thereon defined by upper and lower rails to provide additional space to display and store merchandise, said expander being formed from a flat blank of synthetic plastic material having a rectangular base panel whose opposing long sides are joined by living hinges to corresponding sides of rectangular rear and front panels, the opposing ends of the rear panel being joined by living hinges to end panels whereby erection of the blank is effected by folding up the front and rear panels and swinging in the end panels and latching them to the front and base panels to create a three-dimensional bin, said expander being attachable to said price channel by means of at least two spaced holding clips received in the channel, each holding clip having a high-tack adhesive band to which the rear panel of the expander is attached, each holding clip being provided with a slide plate received between the rails of said channel and a support plate cantilevered from the slide plate to extend above the upper rail of the channel and having said adhesive band thereon, each holding clip having a stiffening ridge spaced below the support plate to contact the rear panel of the expander and thereby help to maintain the expander in a generally level attitude with respect to the shelf, each end panel being provided with an end flange which when the blank is erected overlies the front panel and an edge flange which overlies the base panel to stabilize the bin.

2. An expander as set forth in claim 1, wherein said blank is molded of transparent plastic material.

3. An expander as set forth in claim 2, wherein said material is acrylic.

4. An expander as set forth in claim 1, wherein said base panel is provided with a row of clean-out holes.

5. An expander as set forth in claim 1, wherein the upper edge of the front panel has an elongated U-shaped cut out to facilitate access to the merchandise held in the bin.

6. An expander as set forth in claim 1, wherein latching is effected by detent fingers formed on the end panels which snap into complementary detent recesses on the base panel and the front panel.

* * * * *